US008006436B2

(12) United States Patent
McDaniel

(10) Patent No.: US 8,006,436 B2
(45) Date of Patent: Aug. 30, 2011

(54) SLIDING DOOR INTERLOCKING SYSTEM

(75) Inventor: Kyle A. McDaniel, Johns Creek, GA (US)

(73) Assignee: Alcoa Inc., Pittsburgh, PA (US)

( * ) Notice: Subject to any disclaimer, the term of this patent is extended or adjusted under 35 U.S.C. 154(b) by 93 days.

(21) Appl. No.: 12/366,121

(22) Filed: Feb. 5, 2009

(65) Prior Publication Data

US 2010/0192466 A1 Aug. 5, 2010

(51) Int. Cl.
*E06B 3/42* (2006.01)

(52) U.S. Cl. ..... 49/370; 49/366; 49/367; 52/204.51

(58) Field of Classification Search ..... 49/366, 49/367, 368, 369, 370, 483.1; 52/204.51
See application file for complete search history.

(56) References Cited

U.S. PATENT DOCUMENTS

| | | | | |
|---|---|---|---|---|
| 1,569,602 | A * | 1/1926 | Anderson | 52/204.51 |
| 2,400,009 | A * | 5/1946 | Kuyper | 52/204.51 |
| 2,714,431 | A * | 8/1955 | Peterson | 52/204.51 |
| 4,532,743 | A | 8/1985 | Miller et al. | 52/207 |
| 5,028,082 | A * | 7/1991 | Kronbetter | 292/128 |
| 5,209,018 | A | 5/1993 | Heinrich | 49/449 |
| 5,433,031 | A * | 7/1995 | Dailey | 49/27 |
| 5,638,641 | A * | 6/1997 | Joffe et al. | 49/469 |
| 6,041,552 | A | 3/2000 | Lindahl | 49/458 |
| 6,125,591 | A * | 10/2000 | Schmidhuber et al. | 49/477.1 |
| 7,603,813 | B2 * | 10/2009 | Hackl | 49/506 |
| 2004/0025455 | A1 * | 2/2004 | Nubel et al. | 52/204.51 |
| 2010/0126088 | A1 * | 5/2010 | Young | 52/204.2 |

* cited by examiner

*Primary Examiner* — Jerry Redman
(74) *Attorney, Agent, or Firm* — Greenberg Traurig, LLP

(57) ABSTRACT

A pair of interlocking bi-parting sliding doors includes a first sliding door and a second sliding door, wherein the first sliding door has a first meeting stile that includes a first side portion for maintaining a door glass panel and a first mating side portion for engaging the second sliding door, wherein the first mating side portion includes a plurality of recessed zones, and wherein the second sliding door has a second meeting stile that includes a second side portion for maintaining a door glass panel and a second mating side portion for engaging the first mating side portion of the first sliding door, wherein the second mating side portion includes a plurality of extensions, wherein when the first sliding door and the second sliding door are in a closed position, the plurality of extensions interlock with the plurality of recessed zones.

15 Claims, 7 Drawing Sheets

SLIDING DOOR INTERLOCKING SYSTEM

BACKGROUND

A common problem with sliding door assemblies in which normally one or more panels are moveable and one or more panels are fixed is that wind loads often cause one sliding door to separate from another sliding door, or from the side door jamb. For example, sliding doors that are built in an OXXO configuration create a condition that is generally weaker than the adjacent intermediate verticals. Each door is expected to carry only a portion of the wind load that is applied to the unit. As the doors begin to deflect under these loads, the meeting stiles will pull away from each other. The only mechanical device used to keep the doors together are the locking hardware installed in the mating door stiles. Depending on the performance requirements, it may be necessary to install multiple locks. The performance of the meeting stile is thereby limited by the strength of the locks and not by the structural properties of the door stiles.

SUMMARY

According to an embodiment of the present invention, there is disclosed a door stile that includes a side edge for engaging with a door glass panel; and a mating edge for interlocking with a mating side of a door jamb or a second door stile, wherein the mating edge of the door stile has a three-dimensional surface topography consistent along a vertical height of the door stile for interlocking with the mating side of the door jamb or the second door stile.

According to an embodiment of the present invention, there is disclosed a sliding door that includes a door glass panel; a pair of rails engaging the door glass panel; and a pair of stiles engaging the door glass panel, wherein at least one of the stiles includes a mating edge for interlocking with a mating side of a door jamb or a second door stile, wherein the mating edge of the door stile has a three-dimensional surface topography consistent along a vertical height of the door stile for interlocking with the mating side of the door jamb or the second door stile.

According to an embodiment of the present invention, there is disclosed a pair of interlocking bi-parting sliding doors that includes a first sliding door and a second sliding door, wherein the first sliding door has a first top rail, a first bottom rail, a first end stile, and a first meeting stile, the first meeting stile including a first side portion for maintaining a door glass panel and a first mating side portion for engaging at least a portion of the second sliding door, wherein the first mating side portion includes a plurality of recessed zones running vertically along at least a portion of a vertical height of the first mating side portion of the first sliding door; and wherein the second sliding door has a second top rail, a second bottom rail, a second end stile, and a second meeting stile, the second meeting stile including a second side portion for maintaining a door glass panel and a second mating side portion for engaging the first mating side portion of the first sliding door, wherein the second mating side portion includes a plurality of extensions running vertically along at least a portion of a vertical height of the second mating side portion of the second sliding door, wherein when the first sliding door and the second sliding door are in a closed position, the plurality of extensions interlock with the plurality of recessed zones.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention.

FIG. 1A is an isometric view of the door stile. FIG. 1B is a top plan view of the door stile;

FIG. 2A is an isometric view of the door stile. FIG. 2B is a top plan view of the door stile;

FIG. 3 shows the sliding doors in an open position. One of the sliding doors includes the door stile of FIG. 1, and one of the sliding doors includes the door stile of FIG. 2;

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the present invention.

DETAILED DESCRIPTION

Door stiles, sliding doors including the door stiles, and sliding door assemblies having the sliding doors are disclosed herein. A sliding door assembly of the present invention creates an interlocking system of two sliding doors, wherein the structural properties of each door stile are combined to create an assembly for withstanding the positive and negative pressures applied by a wind load.

As used herein, the term "door stile" refers to a vertical structural member of a door. The door stiles of the present invention include a mating edge for interlocking with a mating side of a door jamb or a second door stile. The mating edge of any of the door stiles of the present invention have a three-dimensional surface topography consistent along a vertical height of the door stile for interlocking with the mating side of the door jamb or the second door stile.

As used herein, the term "side door jamb" refers to the vertical portion of a door frame onto which a door is secured.

As used herein, the term "interlocking" refers to a door stile of the present invention that can engage, by fitting together, with another door stile or a side door jamb.

As used herein, the term "topography" refers to the surface features of a mating edge of a door stile of the present invention. The surface features can include, for example, depressions, protrusions, hooking features and/or catching features.

As used herein, the term "engage", "engaging" or "engaged" refers to contacting or to make contact with something.

As used herein, the term "maintained" refers to be kept in a steady or stationary position.

As used herein, the term "consistent" refers to uniform, unchanging.

As used herein, the term "wind load" refers to the load caused by the wind blowing from any horizontal direction. The wind load can create a positive or negative pressure on a sliding door installed in a building.

As used herein, the term "structural properties" refers to the design strength of a sliding door having a door stile of the present invention.

Figure 1B:
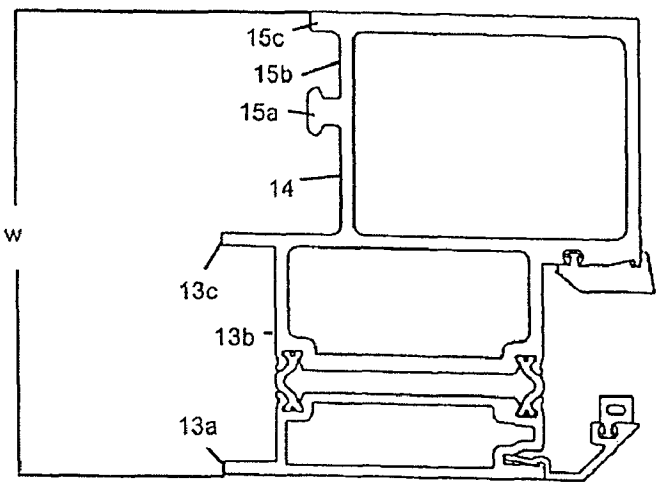
FIGS. 1A and 1B illustrate an embodiment of a door stile of the present invention.
Figure 1A:
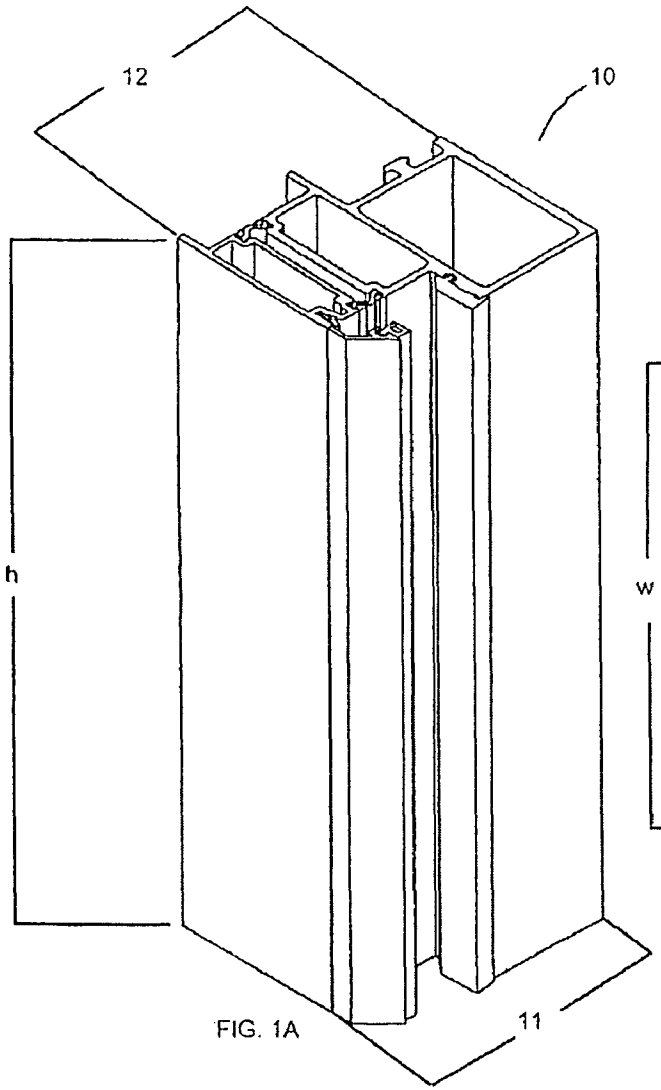

FIGS. 1A and 1B illustrate an embodiment of a door stile 10 of the present invention. The door stile 10 includes a side edge (or surface) 11 for engaging with a door panel, for example, a glass door panel, and a mating edge (or surface) 12 for interlocking with a mating surface of a side door jamb or a second door stile. The mating edge 12 has a unique three-dimensional surface topography consistent along a vertical height "h" of the door stile 10 that allows the door stile 10 to interlock along the vertical height with a mating surface of a side door jamb or a second door stile. If a person's flat hand is placed on the mating edge 12, and moved down the vertical height of the mating edge 12, only a portion (illustrated as extension 13*a* and extension 13*c*) of the mating edge 12 will be in contact with the hand. Extensions 13*a* and 13*c* are separated by a substantially flat recessed area 13*b*. A hooking feature 15*a* and an extension 15*c* are separated by a substantially flat recessed area 15*b*. Between the extension 13*c* and the hooking feature 15*a* is a substantially flat recessed surface 14. The three-dimensional surface topography of the mating edge 12 includes the extensions, the hooking feature, and the recessed surfaces, thus forming a non-flat mating surface 12. In an embodiment, the mating surface 12 of the door stile 10 can be described as including vertical regions of depression 13*b*, 14, and 15*b*, forming a non-flat surface, the regions of depression 13*b*, 14, and 15*b*, capable of interlocking with a side door jamb or a second door stile. In an embodiment, the mating surface 12 of the door stile 10 can be described as having a horizontal width "w" and vertical height "h", wherein the width of the mating edge 12 includes a plurality of flat surfaces 13*b*, 14, and 15*b*, each offset and connected to each other forming substantially flat recessed areas. In an embodiment, the door stile 10 of the present invention can be part of a sliding door of the present invention. A sliding door of the present invention can include a glass panel, a pair of rails engaging the glass panel; and a pair of stiles engaging the glass panel, wherein at least one of the stiles is stile 10 and includes a mating edge 12 having a horizontal width and a vertical height, wherein along the width of the mating edge 12 and running along at least a portion of the height there includes a plurality of flat surfaces 13*b*, 14, and 15*b*, offset and connected to each other forming recessed areas. The mating edge 12 described in FIGS. 1A and 1B illustrate a door stile 10 of the present invention. However, the topography of the mating edge 12, including the various extensions and depressions, can also constructed onto a side door jamb, to create a side door jamb having the mating edge 12 topography as detailed above.

Figure 2B:
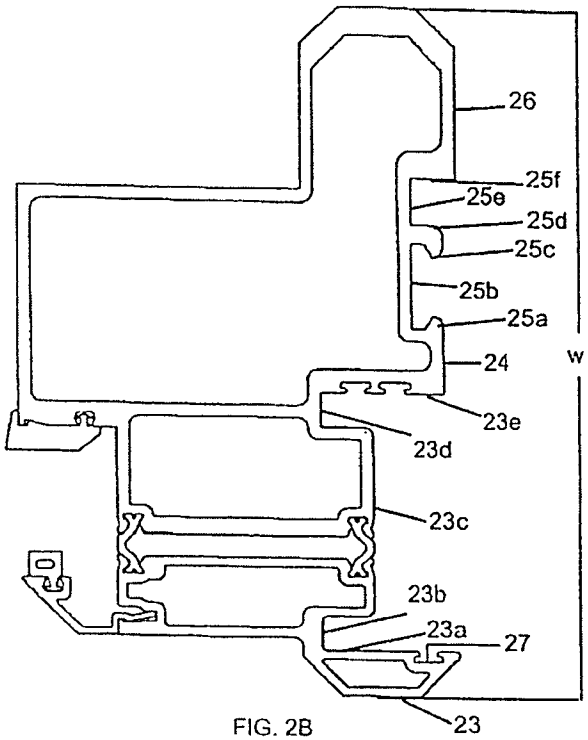
FIGS. 2A and 2B illustrate an embodiment of a door stile of the present invention.
Figure 2A:
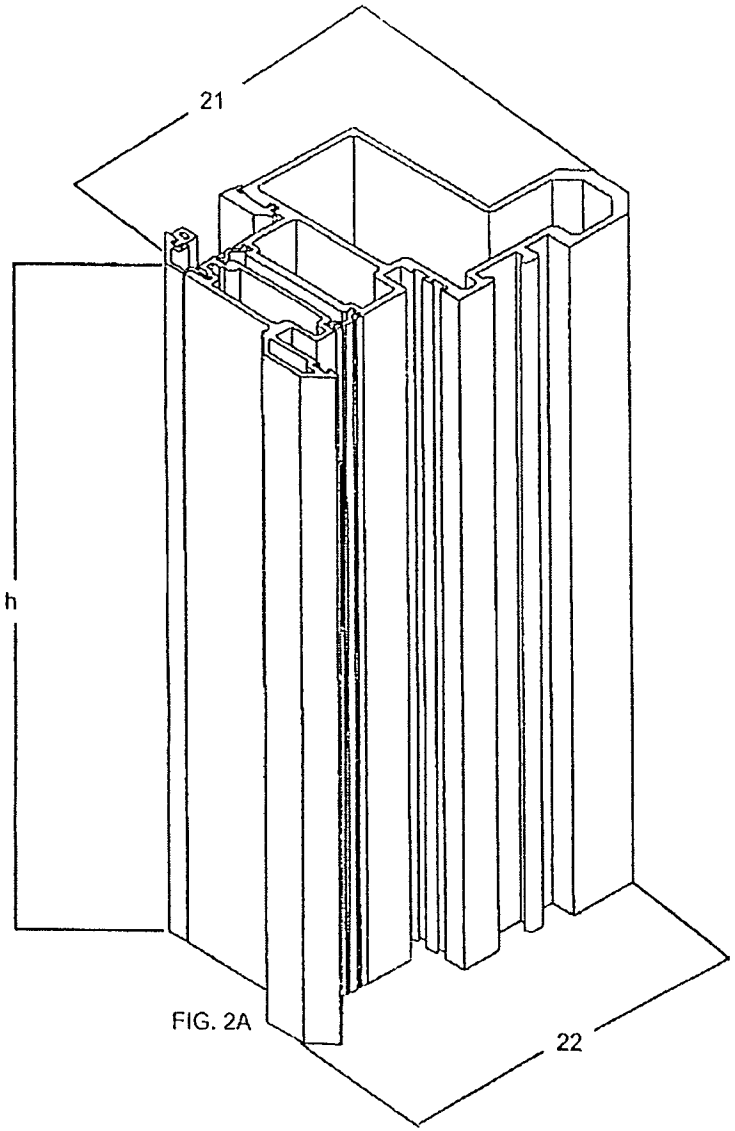

FIGS. 2A and 2B illustrate an embodiment of a door stile 20 of the present invention. The door stile 20 includes a side edge (or surface) 21 for engaging with a door panel, for example, a glass door panel, and a mating edge (or surface) 22 for interlocking with a mating edge of a side door jamb or a second door stile. The mating edge 22 has a unique three-dimensional surface topography that allows the door stile 20 to interlock along a vertical height "h" with a mating edge of a side door jamb or a second door stile. If a person's flat hand is placed on the mating edge 22, and moved down the vertical height of the mating edge 22, only a portion (illustrated as flat area 26 and extension 23) of the mating edge 22 will be in contact with the hand. Inner surface 23*a* of extension 23 and inner surface 23*e* of extension 24 are separated from each other by channel 23*b*, flat recessed surface 23*c*, and channel 23*d*. In an embodiment, extension 23 is about one inch wide and conceals a joint between a pair of sliding doors having a door stile of the present invention. In an embodiment, the extension 23 includes a relief "reglet" 27 that is capable of receiving a weather strip gasket. A catching feature including catch 25*a*, catch 25*c*, and recessed surface 25*b*, is capable of catching a hooking feature of a second door stile or a door jamb. Inner surface 25*d*, flat recessed surface 25*e*, and inner surface 25*f*, are capable of interlocking with an extension of a second door stile or a door jamb. The extensions, catching feature, and recessed surfaces form a non-flat mating surface 22. In an embodiment, the mating surface 22 of the door stile 20 includes vertical regions of depression 23*b*, 23*d*, 25*b* and 25*e*, forming a non-flat surface, the regions of depression 23*b*, 23*d*, 25*b* and 25*e*, capable of interlocking and hooking with a side door jamb or a second door stile. In an embodiment, the mating surface 22 of the door stile 20 can be described as having a horizontal width "w" and vertical height "h", wherein the width of the mating edge 22 includes a plurality of flat surfaces 23*b*, 23*d*, 25*b* and 25*e*, each offset and connected to each other forming recessed areas. In an embodiment, the door stile 20 of the present invention can be part of a sliding door of the present invention. A sliding door of the present invention can include a glass panel, a pair of rails engaging the glass panel; and a pair of stiles engaging the glass panel, wherein at least one of the stiles is stile 20 and includes a mating edge 22 having a horizontal width and a vertical length, wherein along the horizontal width of the mating edge 22 and running along at least a portion of the vertical length there includes a plurality of flat surfaces 23*b*, 23*d*, 25*b* and 25*e*, offset and connected to each other forming recessed areas. The mating edge 22 described in FIGS. 2A and 2B illustrate a door stile 20 of the present invention. However, the topography of the mating edge 22, including the various extensions and depressions, can also constructed onto a side door jamb, to create a side door jamb having the mating edge 22 topography as detailed above.

Figure 3:
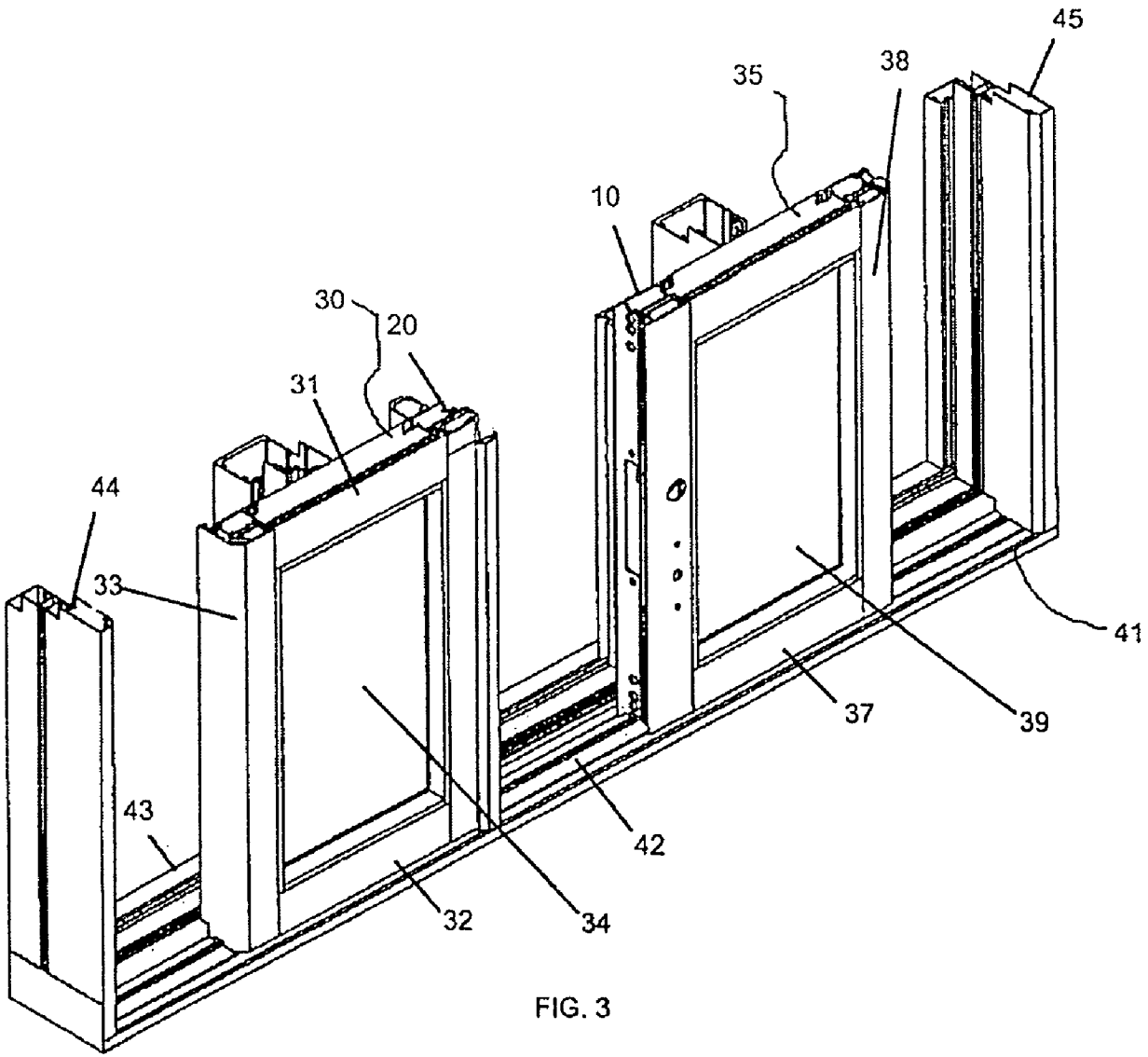
FIG. 3 is a fragmentary isometric front view of an illustrative embodiment of a sliding door assembly of the present invention that includes a pair of interlocking bi-parting sliding doors.
Figure 4:
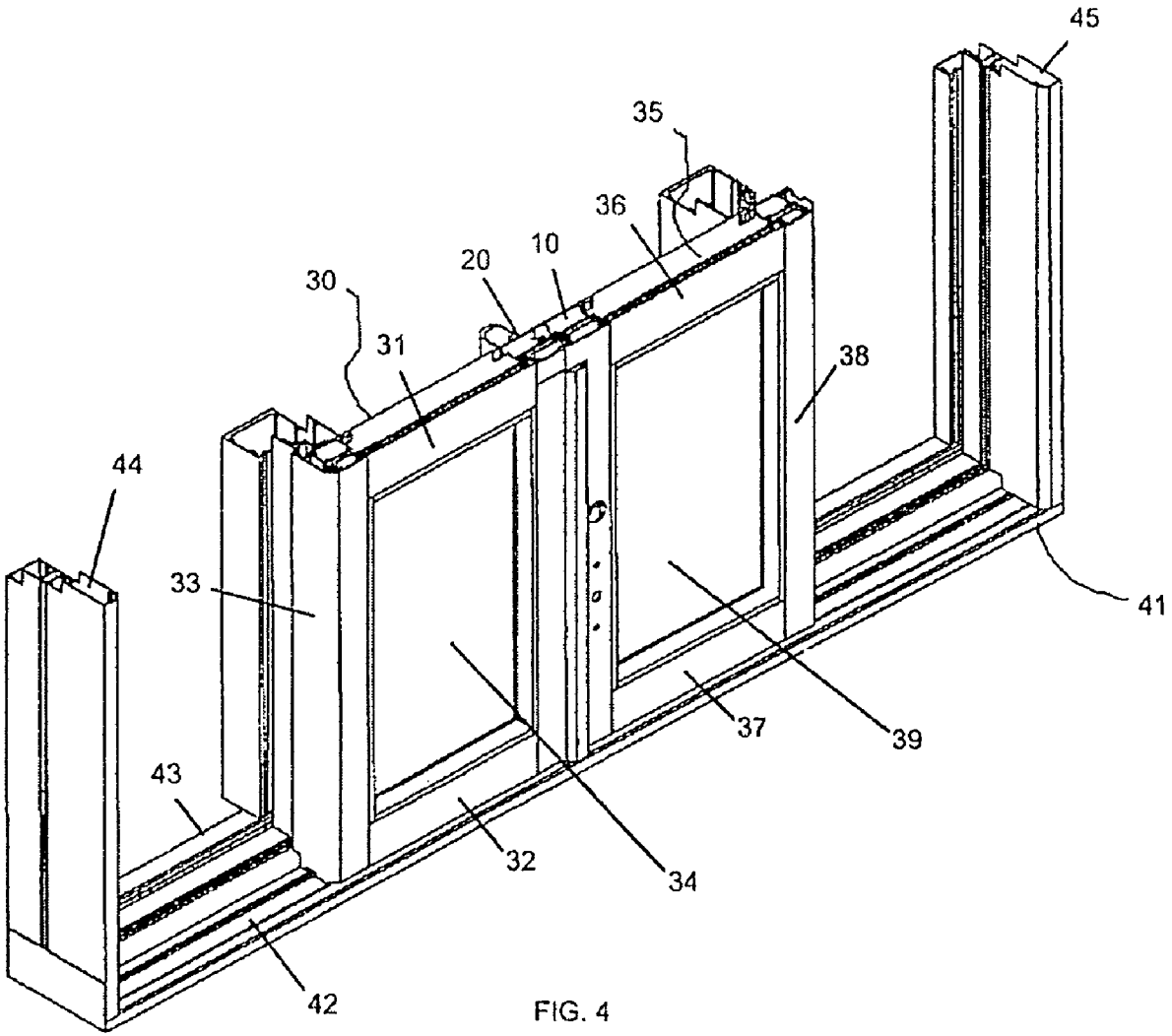
FIG. 4 is a fragmentary isometric front view of the sliding door assembly of FIG. 3, with the sliding doors in a closed position.
Figure 5:
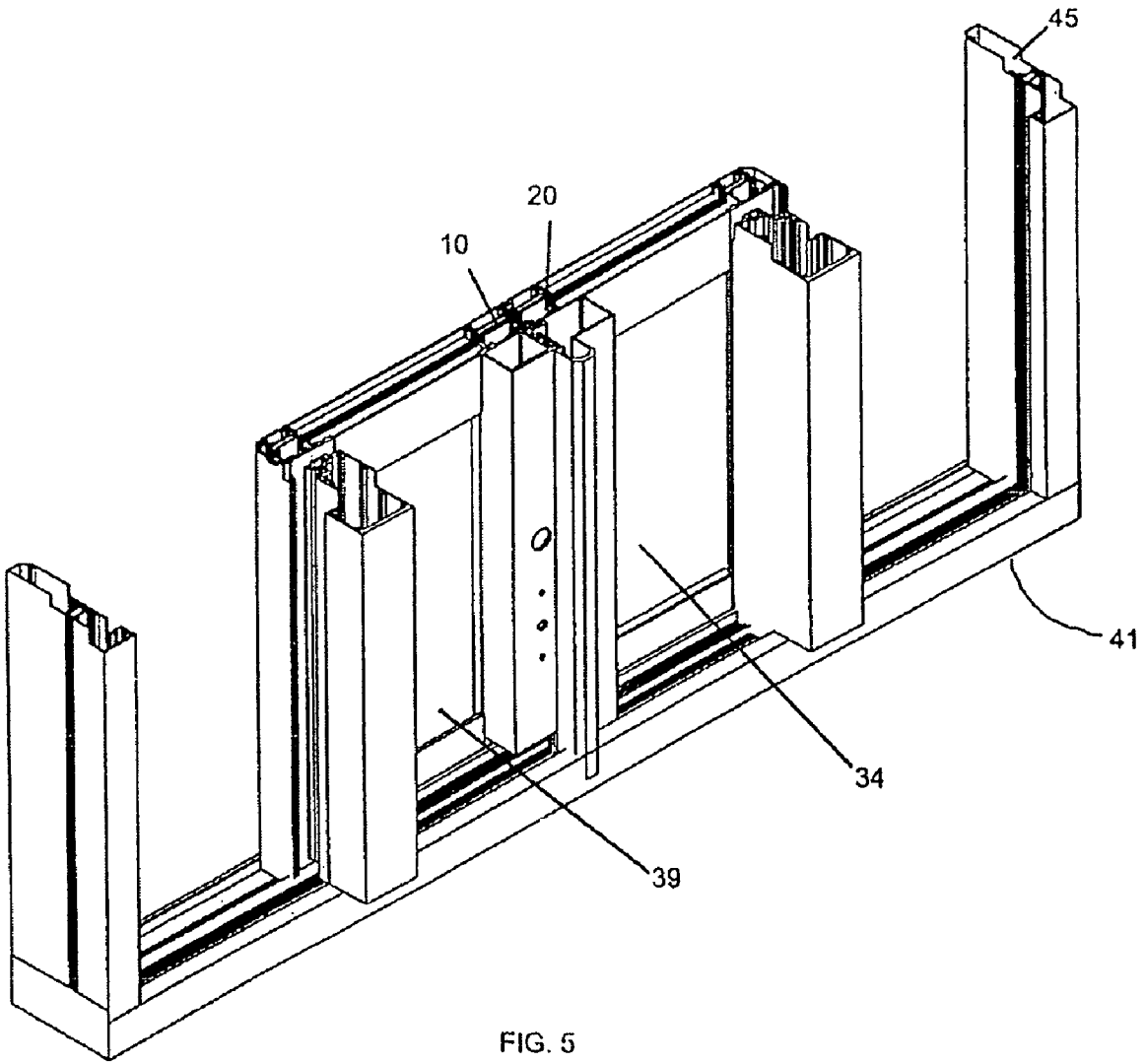
FIG. 5 is a fragmentary isometric back view of the sliding door assembly of FIG. 3, with the sliding doors in a closed position.

FIGS. 3-5 are fragmentary isometric views of an illustrative embodiment of a pair of interlocking bi-parting sliding doors 30 and 35 of the present invention positioned in a door frame assembly in an OXXO configuration. The interlocking bi-parting sliding doors 30 and 35 are fabricated to include the door stiles 20 and 10, respectively. FIG. 3 shows the sliding doors 30 and 35 in an open position. FIG. 4 shows the sliding doors 30 and 35 in a closed position. FIG. 5 shows the sliding doors 30 and 35 in a closed position, as viewed from the back. The door frame assembly includes a head component (not shown) including an operable head for engaging the sliding doors 30 and 35, and a fixed head for engaging a first fixed-panel door and a second fixed-panel door (fixed-panel doors are not illustrated). The door frame assembly also includes a bottom sill component 41 including an operable sill 42 for engaging the sliding doors 30 and 35, and a fixed sill 43 for engaging the first fixed-panel door and the second fixed-panel door. A first fixed door jamb 44 is used to secure the first fixed-panel door, and a second fixed door jamb 45 is used to secure the second fixed-panel door. Sliding door 30 has a top rail 31, a bottom rail 32, an end stile 33, and the stile 20 (also referred to herein as a meeting stile). The stile 20 includes the side edge 21 for maintaining a door glass panel 34 and the mating edge 22 for engaging the stile 10 of sliding door 35. The mating edge 22 of the meeting stile 20 includes a plurality of recessed zones 23*b*, 23*d*, 25*b* and 25*e*. Similarly, sliding door 35 has a top rail 36, a bottom rail 37, an end stile 38, and the stile 10 (also referred to herein as a meeting stile). The stile 10 includes the side edge 11 for maintaining a door glass panel 39 and the mating edge 12 for engaging the mating edge 22 of the sliding door 30. The mating edge 12 of the meeting stile 10 includes a plurality of protrusion members 13*a*, 13*c*, and 15*c*. When the first sliding door 30 and the second sliding door 35 are in a closed position, the plurality of protrusion members 13*a*, 13*c*, and 15*c* interlock with the plurality of recessed zones 23*b*, 23*d* and 25*e*, respectively. The door stiles 10 and 20, include an integral feature that enables the sliding doors 30 and 35 to hook together when loads are applied to the unit (the combination of the sliding doors 30 and 35 in a closed position). The hooking feature 15*a* is positioned within catching feature 25*a*, 25*b*, and 25*c*, forming the integral feature. This engagement feature runs the full vertical length of the door stiles thereby enabling the door stiles to act as one. One of the sliding doors is designed to be weaker than the other sliding door, so that as a wind load is applied to the unit, the weaker sliding door will deflect first and engage into the second sliding door. For example, in an embodiment, sliding door 35 having the door stile 10 is weaker than sliding door 30 having the door stile 20. Locks that can be installed on the sliding doors 30 and 35 for building security are not relied upon to keep the sliding doors 30 and 35 together under the positive and negative pressures produced by the wind load. The meeting door stiles are able to perform at the same level as the other intermediate vertical members, for example, the mullions. Although the door frame assembly illustrated in FIGS. 3, 4, and 5, are shown as having an OXXO configuration, the sliding doors of the present invention are not limited to being used in a sliding door frame assembly having a OXXO configuration. In an embodiment, the sliding doors 30 and 35 can be used in a door frame assembly having an OOXXO configuration. In an embodiment, the sliding doors 30 and 35 can be used in a door frame assembly having an OOOXXO configuration.

Figure 6:
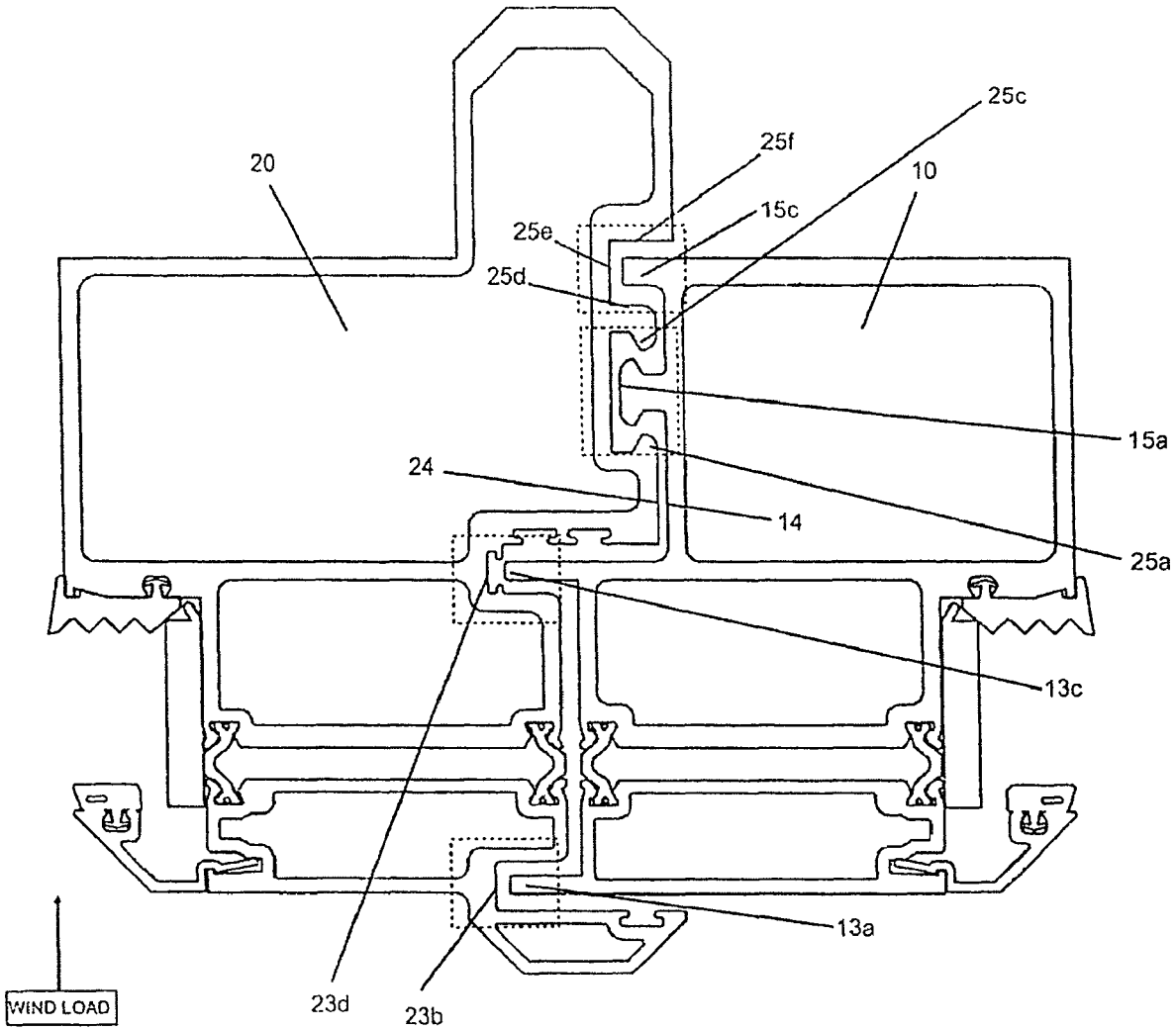
FIG. 6 is a top plan close-up view of the interlocking bi-parting doors of FIG. 4. The door rails and glass panels of each sliding door have been removed.

FIG. 6 is a top plan close-up view of the pair of interlocking bi-parting sliding doors 30 and 35 of FIG. 4 with the door glass panels 34 and 39 removed. FIG. 6 shows how the door stiles 20 and 10 interlock in the closed position. As illustrated in FIG. 6, there are at least four areas (illustrated as dashed boxes) where the two door stiles 20 and 10 interlock with one another. When the two sliding doors 30 and 35 are in the closed position and are subjected to a wind load (see arrow), the hooking feature 15*a* can interlock catching features 25*a*, 25*b* and 25*c*, keeping the two doors 30 and 35 hooked together. Multiple points of contact between the two door stiles 20 and 10, keep the two sliding doors 30 and 35 hooked together and produce the required structural properties (strength) to counter the wind load force being applied to the two sliding doors 30 and 35. Along the vertical height of the mating edge 22 of the door stile 20, and along the vertical height of the mating edge 12 of the door stile 10, channel 23*b* surrounds extension 13*a*, channel 23*d* surrounds extension 13*c*, and channel 25*d* surrounds extension 15*c*. Flat surfaces 14 and 24 run approximately parallel with each other. The horizontal width of the various channels is larger than the horizontal width of the various extensions, therefore when a wind load is placed on the sliding doors 30 and 35, the extensions can move horizontally within the channels along the entire vertical height of the door stiles 20 and 10, respectively. Hooking feature 15*a* can engage catching features 25*a*, 25*b* and 25*c*. This engagement happens when a positive or negative wind load is applied to the sliding doors 30 and 35. The hook engagement enables the mating stiles 20 and 10 to stay together as they deflect due to the wind load. The structural properties of each stile 20 and 10 are combined together to create a stronger assembly. Without the hooking/catching feature, the sliding doors can disengage under a wind load.

Figure 7:
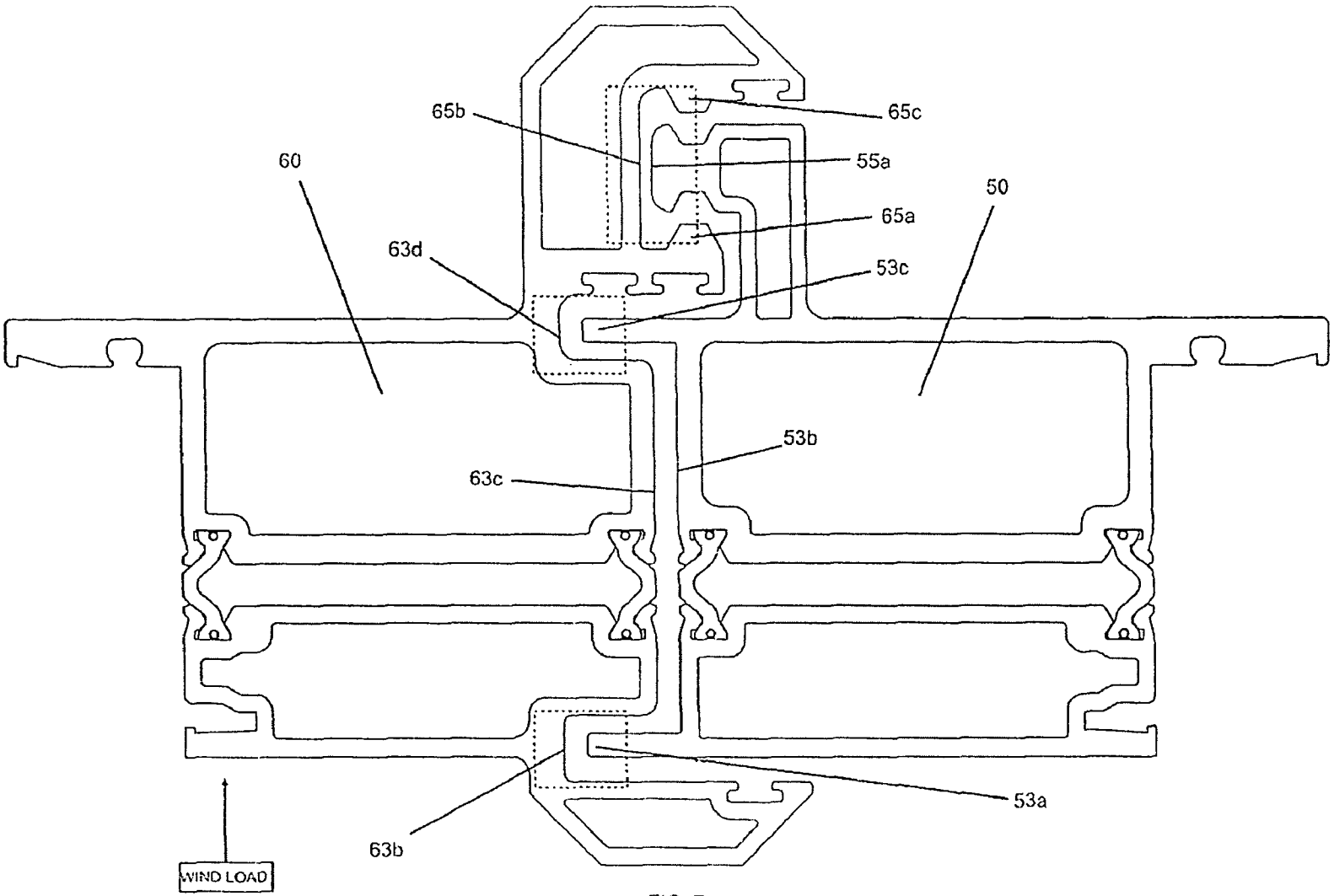
FIG. 7 is a top plan close-up view of a pair of interlocking door stiles of the present invention.

FIG. 7 is a top plan close-up view of a pair of interlocking door stiles 60 and 50 of the present invention. As illustrated in FIG. 7, there are at least three areas (illustrated as dashed boxes) where the two door stiles 60 and 50 can interlock with one another. When two sliding doors having the door stiles 60 and 50 are in the closed position and are subjected to a wind load force, hooking feature 55*a* can interlock catching features 65*a*, 65*b* and 65*c*, keeping the two doors hooked together. Multiple points of contact between the two door stiles 60 and 50, keep the two sliding doors hooked together and produce the required structural properties (strength) to counter the wind load force being applied to the two sliding doors. Along the vertical height of a mating edge of the door stile 60, and along the vertical height of a mating edge of the door stile 50, channel 63*b* surrounds extension 53*a*, and channel 63*d* surrounds extension 53*c*. Flat surfaces 63*c* and 53*b* run parallel with each other. The horizontal width of the various channels is larger than the horizontal width of the various extensions, therefore when a wind load is placed on the sliding doors, the extensions can move horizontally within the channels along the entire vertical height of the door stiles 60 and 50, respectively. Hooking feature 55*a* can engage catching features 65*a* and 65*c*. This engagement happens when a positive or negative wind load is applied to the sliding doors. The hook engagement enables the mating stiles 60 and 50 to stay together as they deflect due to the wind load. The structural properties of each stile 60 and 50 are combined together to create a stronger assembly. Without the hooking/catching feature, the sliding doors can disengage under a wind load.

While illustrative embodiments of the invention are disclosed herein, it will be appreciated that numerous modifications and other embodiments may be devised by those skilled in the art. Therefore, it will be understood that the appended claims are intended to cover all such modifications and embodiments that come within the spirit and scope of the present invention.

What is claimed is:

1. A pair of interlocking bi-parting sliding doors comprising:

a first sliding door and a second sliding door, wherein the first sliding door has a first top rail, a first bottom rail, a first end stile, and a first meeting stile, the first meeting stile including a first side portion for maintaining a door glass panel and a first mating side portion for engaging at least a portion of the second sliding door, wherein the first mating side portion includes at least two recessed zones running vertically along at least a portion of a vertical height of the first mating side portion of the first sliding door, and wherein the first mating side portion includes at least two catching features running vertically along at least a portion of the vertical height of the first mating side portion of the first sliding door; and wherein the second sliding door has a second top rail, a second bottom rail, a second end stile, and a second meeting stile, the second meeting stile including a second side portion for maintaining a door glass panel and a second mating side portion for engaging the first mating side portion of the first sliding door, wherein the second mating side portion includes at least two extensions running vertically along at least a portion of a vertical height of the second mating side portion of the second sliding door, and wherein the second mating side portion includes a hooking feature running vertically along at least a portion of the vertical height of the second mating side portion of the second sliding door, wherein the hooking feature is sufficiently designed to engage with the catching features so as to effect engagement of the first sliding door with the second sliding door under a wind load, wherein when the first sliding door and the second sliding door are in a closed position, the plurality of extensions interlock with the plurality of recessed zones.

2. The sliding doors of claim 1 wherein when a positive wind load is applied to the sliding doors in the closed position, the first mating side of the first meeting stile maintains interlocked with the second mating side of the second meeting stile.

3. The sliding doors of claim 1 wherein when a negative wind load is applied to the sliding doors in the closed position, the first mating side of the first meeting stile maintains interlocked with the second mating side of the second meeting stile.

4. The sliding doors of claim 1 wherein the at least two extensions interlock with the at least two recessed zones at three locations.

5. The sliding doors of claim 1 for use in a sliding door frame assembly having a 4-panel door configuration.

6. The sliding doors of claim 5 wherein the door frame assembly comprises:

a first fixed-panel door maintained in a stationary position;

a second fixed-panel door maintained in a stationary position;

a head component including an operable head for engaging the first sliding door and the second sliding door, and a fixed head for engaging the first fixed-panel door and the second fixed-panel door;

a bottom sill component including an operable sill for engaging the first sliding door and the second sliding door, and a fixed sill for engaging the first fixed-panel door and the second fixed-panel door;

a first fixed jamb for securing the first fixed-panel door; and a second fixed jamb for securing the second fixed-panel door.

7. The sliding doors of claim 1 for use in a door frame assembly having a 5-panel door configuration.

8. The sliding doors of claim 1 for use in a door frame assembly having a 6-panel door configuration.

9. The sliding doors of claim 1 wherein when a positive wind load is applied to the sliding doors in the closed position, the first sliding door and the second sliding door maintain together due to engagement of the hooking feature with the catching features.

10. The sliding doors of claim 1 wherein when a negative wind load is applied to the sliding doors in the closed position, the first sliding door and the second sliding door maintain together due to engagement of the hooking feature with the catching features.

11. The sliding doors of claim 1 wherein when a positive wind load is applied to the sliding doors in the closed position, the first sliding door and the second sliding door maintain together without the aid of locking hardware.

12. The sliding doors of claim 1 wherein when a negative wind load is applied to the sliding doors in the closed position, the first sliding door and the second sliding door maintain together without the aid of locking hardware.

13. The sliding doors of claim 1 wherein the at least two extensions interlock with the at least two recessed zones at two locations.

14. The sliding doors of claim 1 wherein the hooking feature is sufficiently designed to engage with the catching features so as to enable the first meeting stile and the second meeting stile to act as one unit and stay together as the first meeting stile and the second meeting stile deflect.

15. The sliding doors of claim 1 wherein the hooking feature is sufficiently designed to engage with the catching features only when the first sliding door and the second sliding door deflect.

* * * * *